United States Patent [19]

Fukada et al.

[11] 4,221,317

[45] Sep. 9, 1980

[54] APPARATUS FOR CONTROLLING THE FEED OF YARN

[75] Inventors: Minoru Fukada, Sakado; Zen Sakaguchi, Hanno; Kenichi Hasegawa, Tokyo, all of Japan

[73] Assignee: Hiraoka Kogyo Kabushiki Kaisha, Saitama, Japan

[21] Appl. No.: 57,110

[22] Filed: Jul. 12, 1979

Related U.S. Application Data

[63] Continuation-in-part of Ser. No. 865,137, Dec. 28, 1977, abandoned.

[30] Foreign Application Priority Data

Dec. 28, 1976 [JP] Japan ..... 51-160354

[51] Int. Cl.[2] ..... B65H 51/02

[52] U.S. Cl. ..... 226/188; 74/661; 112/79 A; 226/178

[58] Field of Search ..... 226/168, 174, 178, 188; 74/661, 665 R, 665 A, 665 B, 665 D, 665 Q; 112/79 R, 79 A, 266.2

[56] References Cited

U.S. PATENT DOCUMENTS

| | | | |
|---|---|---|---|
| 2,573,011 | 10/1951 | Gruber | 74/661 X |
| 3,075,482 | 1/1963 | Card | 112/79 A |
| 3,489,326 | 1/1970 | Singleton | 226/188 X |
| 3,605,660 | 9/1971 | Short | 112/79 A |
| 3,847,098 | 11/1974 | Hammel, Jr. | 112/79 A |
| 3,906,876 | 9/1975 | Fitton | 112/79 A |
| 3,926,132 | 12/1975 | Lear et al. | 112/79 A |
| 3,955,514 | 5/1976 | Prichard et al. | 112/79 A |
| 3,981,253 | 9/1976 | Neyraud | 112/79 A |

*Primary Examiner*—Stanley N. Gilreath
*Attorney, Agent, or Firm*—Oblon, Fisher, Spivak, McClelland & Maier

[57] ABSTRACT

A method and apparatus for feeding yarn during a single stitch of a needle such that the mean rotational frequency of a yarn feeding drum connected to a first and second driving member is changed during the single stitch of the needle so as to regulate and control the feeding of the yarn and provide a maximum and minimum yarn length in the resulting stitch or selectively provide a yarn length between the maximum or minimum length.

1 Claim, 11 Drawing Figures

APPARATUS FOR CONTROLLING THE FEED OF YARN

This application is a continuation-in-part of our earlier application Ser. No. 865,137 filed Dec. 28, 1977, now abandoned.

BACKGROUND OF THE INVENTION

1. Field of the Invention

The present invention relates to a method of controlling the feed of yarn and a device for controlling the feed of yarn.

2. Description of the Prior Art

In a conventional tufting machine there has been provided one method of decorating with patterns by changing the height of yarn. Thus, it is necessary to control the feed yarn during one stitch of a needle and change the height of the yarn provided. There are various methods used for the control of the feed of yarn which can be classified by the following two types of methods of (1) changing the feed speed of the yarn and (2) changing the feed lapse time of the yarn.

As an ordinary method of changing the feed speed of yarn, there has been provided a method of changing the speed of the feed drum in two steps consisting of a high speed and a low speed. However, in this ordinary method, a drawback exists in that various changes can not be offered as only two steps of change are possible in this method.

As an ordinary method of changing the feed lapse of time of yarn, there has been provided a method of controlling the rotation period of a yarn feed drum by using a pulse motor as the driving power. However, in this ordinary method, there occurs a drawback in that the composition of the device for operation in this method is necessarily very complex, the technique for controlling the feed quantity of yarn is difficult, the control as a whole of the plurality of elements of the device of the method is very difficult, and maintenance thereof is troublesome since the durability of the device is low.

The present invention is a result of research with respect to various ways of deleting the defects described above and a manner of controlling a device for feed quantity regulation of yarn without controlling the driving power portion thereof. The method and apparatus of the present invention can obtain the necessary feed quantity of yarn by the control of a mean rotational frequency of yarn feed drum during one stitch by changing the rate of the periods in which two kinds of driving bodies are respectively driven with respective predetermined speeds during one stitch of a needle.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

SUMMARY OF THE INVENTION

In the present invention, one driving unit body is rotated with a rotational velocity $\omega H$ by which the highest pile height can be obtained and the other driving unit body is rotated with a rotational velocity $\omega L$ by which the lowest pile height can be obtained.

Therefore, if a yarn feed drum is driven during a period of one stitch by the driving unit body that rotates with the rotational velocity $\omega H$, the highest quantity of yarn is to be fed and the pile height obtained in this case forms the highest pile height. Moreover, if a yarn feed drum is driven during a period of one stitch by a driving unit body that rotates with a rotational velocity $\omega L$, the lowest quantity of yarn is to be fed and a resulting pile height obtained forming the lowest pile height.

Further, during the period of one stitch, if the rate of one lapse of time in which the yarn feed drum is driven by the driving unit body rotating with a rotational velocity $\omega H$ and the other lapse of time in which the yarn feed drum is driven by the driving unit body rotating with a rotational velocity $\omega L$ is changed, when the yarn feed drum is rotated by the driving unit body rotating with a rotational velocity $\omega H$, the quantity of yarn corresponding to the rotational velocity $\omega H$ is fed. When the yarn feed drum rotational velocity is then changed and is rotated by the driving unit body rotating with a rotational velocity $\omega L$, the quantity of yarn corresponding to the rotational velocity $\omega L$ is fed. Therefore, the feed quantity of yarn during the period of one stitch can be changed. Also, by calculating the mean rotational velocity during the period of one stitch from the data denoting the rate of one lapse of time in which the yarn feed drum is driven by the velocity $\omega H$ and the other lapse of time in which the yarn feed drum is driven by the velocity $\omega L$, the feed quantity of yarn during said period of one stitch can be determined. Therefore, the necessary pile height can be obtained by changing the rate of velocity $\omega H$ and velocity $\omega L$ and regulating the pile height, without stages, linearly from the lowest loop height to the highest loop height.

DETAILED DESCRIPTION OF THE PREFERRED EMBODIMENTS

Figure 1:
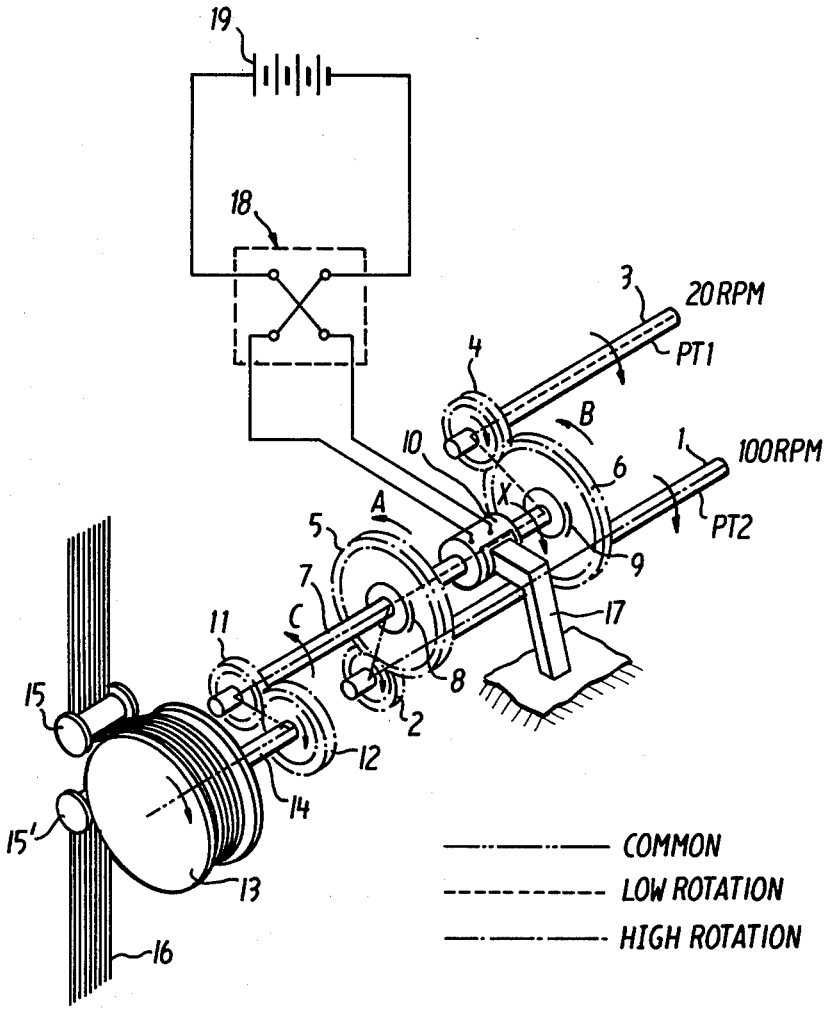
FIG. 1 is an elevational view which shows the first preferred embodiment of the present invention.
Figure 9:
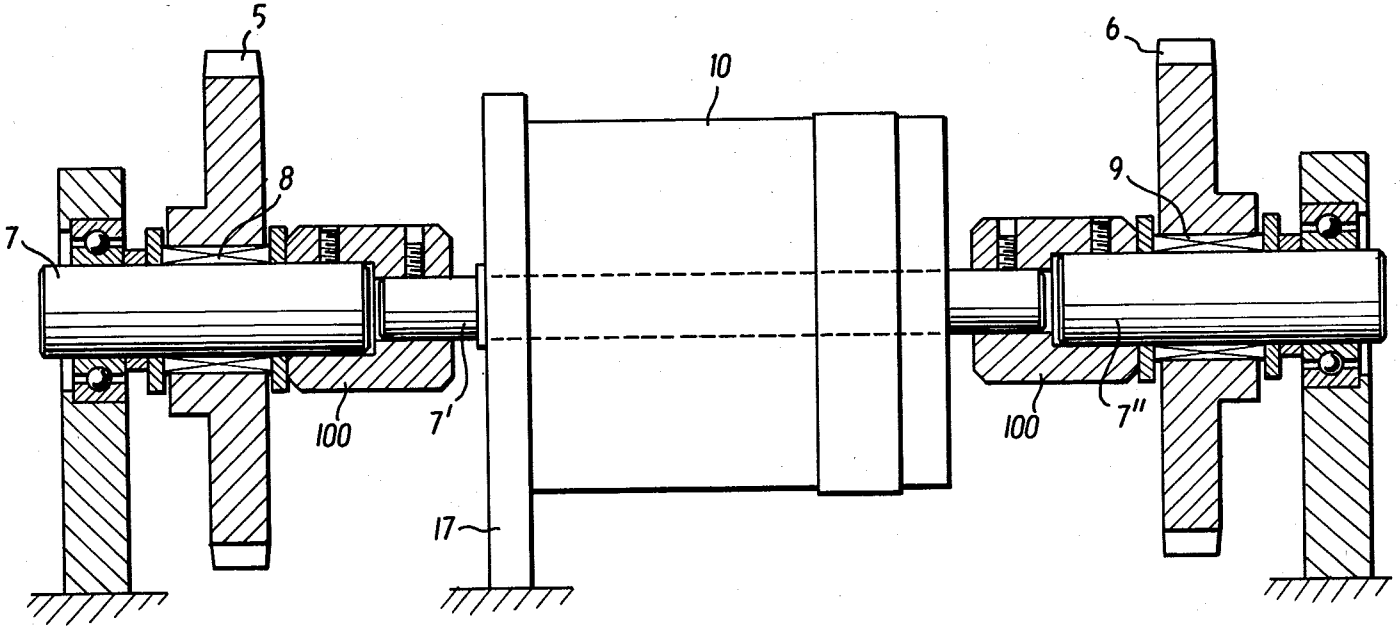

Accordingly, the present invention will now be explained in detail according to a preferred embodiment thereof as shown in FIGS. 1 and 9. A small diameter gear 2 is fixed on one end of a shaft 1 and comprises a driving unit body for providing the highest pile length. A shaft 3 is disposed in parallel position to the shaft 1, with shaft 3 being the driving unit body that offers the lowest pile length, and on shaft 3 is fixed a small diameter gear 4 which has the same diameter as gear 2 at the position where the gear 4 does not face the gear 2. Both small diameter gears 2, 4 respectively engage large diameter action gears 5, 6 and rotate in the same direction. Both large diameter action gears 5, 6 are penetrated by and mounted on action shaft 7 and shaft 7", respectively, and are rotated in a counterclockwise direction by the actions of a clutch 8 and a clutch 9 mounted respectively between shaft 7 and large diameter gear 5, and between shaft 7" and large diameter gear 6.

Also, between large diameter gear 5 and large diameter gear 6 on action shaft 7' is disposed a reversible motor 10 extending from support arm 17 which can rotate action shaft 7 counterclockwise and connects large diameter gear 5 and large diameter gear 6 by couplings 100. Furthermore, at one end of action shaft 7 is mounted a driving gear 11 which engages a following gear 12 mounted on a following shaft 14 driving a yarn feed drum 13. At the vicinity of this yarn feed drum 13, a guide roll 15 and a guide roll 15' are equipped vertically with a space provided between each other, and a plurality of yarns 16 are wrapped around the yarn feed drum 13 which feeds yarn 16 according to the rotation thereof.

The shaft 1 for the highest pile length use and the shaft 3 for the lowest pile length use may be respectively drive by one motor for the highest pile length use and another motor for the lowest pile length use or may be driven by the driving power of the tufting machine itself to which the differential speed device is equipped and which can give respective different speeds to shaft 1 and to shaft 3.

As shown in FIGS. 1 and 9, one way clutch 8 of the gear 5 is locked when the shaft 7 and shaft 7' begin to rotate in a counterclockwise direction (the direction shown by the arrow A) and one way clutch 9 of the gear 6 is locked when the shaft 7" has torque applied thereto in the clockwise direction (direction shown by arrow X).

As described above, the locking directions of the one way clutch 8 and the one way clutch 9 are in reverse relation to each other.

The rotational torque of the motor 10 is less than that of shafts 1 and 3 with shafts 1 and 3 being rotated in the same direction at respective constant rotational speeds as discussed hereinbelow. Even so, the direction of rotation of shaft 7 is always the same as indicated by arrow C.

The motor 10 serves only as a mechanism for engagement and disengagement of clutches 8 and 9 with gears 5 and 6, respectively due to application of torque to shaft 7 or 7" via shaft 7' but does not serve to rotate gear 11.

The reversible motor 10 is a regular DC servo motor which includes a frame which is tightly secured to the framework of the device by means of a support arm 17. The motor 10 is such that the shaft 7' thereof is rotated but the frame is not rotated. As illustrated in FIG. 1, motor 10 is connected to the DC power supply source 19 via a change-over switch 18 and the polarity of the power supply to the motor 10 can be changed over by shifting switch 18.

When rotation of shaft 1 is to be transmitted to the drum 13, switch 18 is actuated in such a manner that the motor 10 provides a torque to shaft 7' in the direction as marked by arrow A. As the motor 10 provides torque to shaft 7' in such direction, one-way clutch 8 is brought into locking engagement with gear 5 because shaft 7' and 7 are designed to rotate at a higher speed than that of gear 5. As a result, rotation of the shaft 1 is conveyed to the shaft 7 via the power train PT1 as shown in FIG. 1. In the meantime, one-way clutch 9 and gear 6 are disengaged with the result that rotational power or torque of shaft 3 is not transmitted to the shaft 7 via shaft 7' and 7".

Next, when rotation of the shaft 3 is to be transmitted to the drum 13, switch 18 is actuated in the opposite manner so that the shaft 7' of motor 10 and shaft 7" are given a torque direction designated by arrow X. Thus, one-way clutch 9 is brought into locking engagement with gear 6 such that rotation of shaft 3 is conveyed to the shaft 7 via power train PT2. Although torque is applied to shaft 7" and 7' in the direction of arrow X by motor 10, shaft 7" and shaft 7' are rotated in a counterclockwise direction as shown by arrow B. At this time, the one-way clutch is disengaged because gear 5 to which rotation of the shaft 1 is transmitted is rotated at a higher velocity than that of shaft 7. Therefore, no rotational force is transmitted from the shaft 1 to shaft 7.

Accordingly, when an electric current is supplied to the motor 10 and the shaft 7 is intended to rotate with a greater rotational frequency than 100 R.P.M. (generally with the rotational frequency of 300 R.P.M.—rotations per minute), because of the greater number of rotations of the shaft 7 than those of gear 5, the one way clutch 8 is locked and shaft 7 is forced to follow the rotational frequency of the gear 5 which is 100 R.P.M.

Moreover, it is a matter of course that the torque of the shaft 1 is larger than that of the motor 10 and in this condition the rotation torque of the gear 6 cannot be transmitted to the shaft 7 because the one way clutch 9 is not in a locked condition.

In other words, when torque in a clockwise direction (the direction shown by arrow X) is generated in the motor 10, the direction of such torque and the locking direction of the one way clutch 9 coincide with each other and accordingly the shaft 7 and the gear 6 are in a locked condition with each other, whereby the shaft 7 can be made to rotate with a rotational velocity of 20 R.P.M. in the direction denoted by the arrow A.

In the condition described above the torque generating direction of the motor 10 and the rotating direction of the shaft 7 are in reverse relation to each other, and accordingly the shaft 7 rotates opposite the direction of torque from the motor 10, wherein the shaft 7 rotates with a rotational frequency of 20 R.P.M. which is slower than that of gear 5.

Accordingly, the one way clutch 8 becomes unlocked and the rotational torque of the shaft 1 cannot be transmitted to the shaft 7. Therefore, the driving force source of the drum 13, when the drum 13 rotates with a low rotational frequency is derived from the shaft 3.

In summary, in the case wherein the shaft 7' motor 10 is made to rotate in a counterclockwise direction, gear 2 rotates toward the direction denoted by arrow A, gear 5 rotates toward the direction denoted by arrow B, the shaft 7 is provided with a rotating frequency of 300 R.P.M. by the motor 10, the one way clutch 8 is locked and insofar as the rotational torque of the gear 5 is greater than that of the motor 10, the shaft 7 cannot rotate with a greater rotational frequency than 100 R.P.M. and continues to rotate with the rotation frequency of 100 R.P.M.

In the other case wherein the shaft 7" of motor 10 has a clockwise direction torque applied thereto, the gear 4 rotates toward the direction denoted by the arrow A with the rotational frequency of 20 R.P.M., the shaft 7 being proved with a torque in the direction denoted by the arrow C by the motor 10, one way clutch 9 is locked, and the shaft 7 is made to rotate in the direction denoted by the arrow B with a rotational frequency of 20 R.P.M.

The effect of the above is that the rotational frequency of the drum 13 can be changed freely and correctly by only setting the rotational frequency of the shaft 3 and the shaft 1 with the aid of the change of the period of time wherein the clockwise torque or the counterclockwise torque of the motor 10 is generated.

Therefore, by giving reversible motor 10 a clockwise directional torque or a counterclockwise directional torque, yarn feed drum 13 can be driven with the rotational frequency corresponding to the rate of the respective rotation of gear 5 and gear 6. Accordingly, if the reversible motor 10 provides a clockwise directional torque and a counterclockwise directional torque with the ratio of one period in which the reversible motor 10 rotates clockwise and the other period in which the motor 10 rotates counterclockwise being one to five, during one stitch, during the half period of one stitch action shaft 7 rotates with the rotational frequency of 100 RPM and during the other half period of one stitch action shaft 7 rotates with a rotational frequency of 20 RPM, the mean rotational frequency of action shaft 7 becoming, as a result, 60 RPM during one stitch and yarn feed drum 13 being rotated with a rotational frequency of 15 RPM whereby the loop height reaches the mean loop height between the highest loop height and the lowest loop height.

Some experimental data denoting the relations among the rates of one period in which the reversible motor 10 rotates clockwise and the other period in which the reversible motor 10 rotates counterclockwise, action shaft 7, the rotational frequency of yarn feed drum 13, and the loop pile height, are shown with respect to the present invention in the following table.

TABLE

| The mean rotational frequency (RPM) of action shaft 7 | The mean rotational frequency (RPM) of yarn feed drum 13 | The loop pile height m/m | The state of the current applied to the reversible motor for the torque direction thereof |
|---|---|---|---|
| 100 | 24 | 15 | The current is for the counterclockwise direction torque rotation |
| 60 | 15 | 9.4 | The counterclockwise current and clockwise current ratio is one to one |
| 73 | 18.25 | 11.4 | The counterclockwise current and clockwise current ratio is two to one |
| 47 | 11.75 | 7.3 | The counterclockwise current and clockwise current ratio is one to two |
| 20 | 4.8 | 3 | The current is for the clockwise direction torque |

It is evident that any loop height different from the above denoted heights in the table can be obtained by changing the outer diameter of the yarn feed drum, the gear ratio between driving gear 11 and following gear 12 and the rotational frequencies of shaft 1 for the highest use and shaft 3 for the lowest use. Further, by experimental datum with respect to the present invention, the lock torque of the one way clutch was 2 Kg-cm. The lock torque is the assured largest torque that does not overheat reversible motor 10 under the locked state of action shaft 7 for an extended period of time. Therefore, it is necessary to use a current to reversible motor 10 that does not overheat reversible motor 10 by a lock torque of 2 Kg-cm. In other words, the reversible motor 10 does not overheat when it is used with electric current that gives it a lock torque which is 2 Kg-cm in this case. It should also be noted that, instead of the reversible motor 10, a separate clockwise motor and a counterclockwise motor can be respectively connected to action shaft 7.

In the above-described first embodiment, yarn feed drum 13 can feed any quantity of yarn linearly by changing the pile height from the highest pile height to the lowest pile height by itself. Therefore, the apparatus of the present invention is simple in structure and is very easy to control. A mean pile length can be controlled linearly by setting one angular speed that gives the highest pile length and the other angular speed that gives the lowest pile length and changing the ratio between the period of one speed and the period of the other speed by electric signals.

Figure 2:
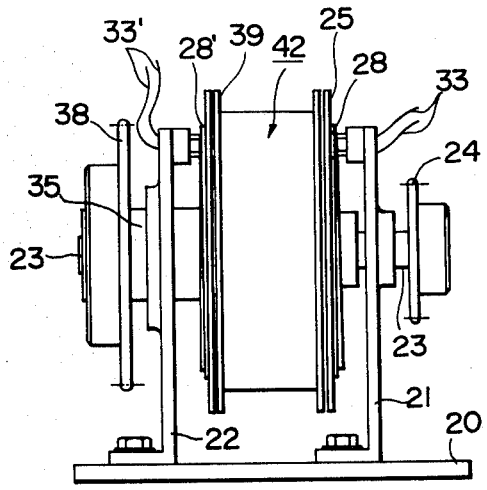
FIG. 2 is a plan view of a second preferred embodiment of the present invention.

A second preferred embodiment of the present invention will now be explained in detail with particular reference to FIGS. 2, 3 and 4. As shown in FIG. 2, a rotary shaft 23 is freely supported to rotate on a journal bearing 21 directly and on a journal bearing 22 indirectly which are respectively fixed on a base plate 20 with a space provided between each other. On one end of rotary shaft 23 is fixed a sprocket wheel 24 and on the central portion side of rotary shaft 23 as well as on the left side of said journal bearing 21 is fixed a rotary force transmission disk 25, sprocket wheel 24 being connected to a driving motor, not shown, and being set so that sprocket wheel 24 can always rotate rotary shaft 23 with a rotational frequency corresponding to the longest pile height.

Figure 3:
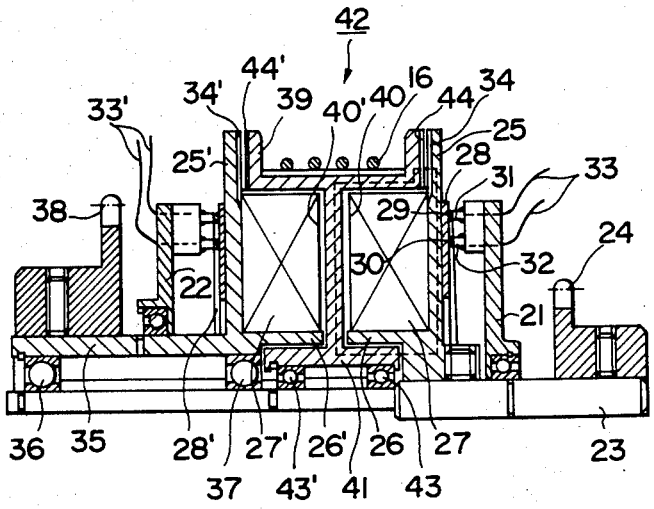
FIG. 3 is a partial sectional view which shows the principal structure of the embodiment of FIG. 2.

On rotary force transmission disk 25 is mounted a coil wound cylindrical part 26 facing and horizontally elongated with respect to journal bearing 22 at the central portion thereof as shown in FIG. 3. Around coil wound cylindrical part 26 a coil is wound in a doughnut-like shape to form a toroidal coil portion 27. Also, concentric slip rings 29, 30 are set on the central portion of rotary force transmission disk 25 at the side of journal bearing 21 thereof by the aid of ring type insulating material 28, the concentric slip rings 29, 30 being respectively connected to toroidal coil portion 27 electrically. On the other hand, brushes 31, 32 are respectively mounted on the upper end of journal bearing 21 as shown in FIG. 3, brushes 31 and 32 being respectively in contact with slip rings 29, 30 so as to be able to feed electric current to toroidal coil portion 27 through electric current feed wire 33. On the round periphery of rotary force transmission disk 25 at the side facing journal bearing 22 is mounted a teeth portion 34 having continuously and radially lined concave and convex teeth.

Further, at the side facing journal bearing 22 is mounted a rotary force transmission disk 25' which is formed similarly to that of rotary force transmission disk 25. Accordingly, a coil wound cylindrical portion 26' supporting a toroidal coil portion 27' is set so as to face coil wound cylindrical portion 26 and, in a direction extending opposite that of said coil wound cylindrical portion 26', is disposed a cylindrical journal bearing pipe 35 within which bearings 36, 37 are provided to support a freely rotating rotary shaft 23. A sprocket wheel 38 is fixed at one end of cylindrical journal bearing pipe 35, sprocket wheel 38 being connected to a driving source such as a motor, not shown, whereby cylindrical journal bearing pipe 35 is rotatable with a rotational speed corresponding to the lowest pile height.

Concentric slip rings 29', 30' are mounted on force transmission disk 25' with the aid of a ring type insulating material 28' as well as rotary force transmission disk 25, concentric slip rings 29', 30' being respectively in contact with brushes 31', 32' mounted on journal bearing 22 to feed electric current to the toroidal coil 27' through an electric current feed wire 33' and with teeth portion 34 being formed on the periphery portion of the side surface of rotary force transmission disk 25' facing journal bearing 21.

Between force transmission disk 25 and force transmission disk 25' is set a yarn winding portion 39 having flanges at the both ends thereof. At the periphery core portion are set coil insertion portions 40, 40' for inserting respectively toroidal coils 27, 27'. At the central portion of rotary shaft 23 is mounted a yarn feed drum 42 made of magnetic material having a rotary supporting cylinder 41 with a vertical inner central plate crossing a space disposed between coil wound cylindrical parts 26, 26' respectively with yarn feed drum 42 being freely supported to rotate by journal bearings 43, 43' which are respectively set between the inner side wall of rotary supporting cylinder 41 and rotary shaft 23. Further, on both outside walls of yarn winding portion 39 are respectively formed a teeth portion 44 and a teeth portion 44' which are radially set, having concave and convex teeth and facing teeth portions 34, 34' with a small space provided therebetween.

In the second embodiment as described above, the rotary force transmission disks 25, 25' are rotated with respective constant speed by means of sprocket wheels 24, 38 which are respectively driven by respective power sources such as motors, not shown. If the rotary force transmission disk 25 is continuously rotated with rotational frequency of 24 RPM and the rotary force transmission disk 25' is continuously rotated with rotational frequency of 4.8 RPM, then all yarn 16 to be fed is wound around yarn feed drum 42. A pair of guide rolls are set vertically near the yarn feed drum 42 so that the yarn 16 does not slip on the yarn feed drum 42, and subsequently, electric current is applied to the toroidal coil 27 in rotary force transmission disk 25 and a magnetic closed circuit or loop shown by dotted line in FIG. 3 is formed on the portions of the rotary force transmission disk 25 around the toroidal coil 27. As the teeth portion 44 of yarn feed drum 42 is in the magnetic closed loop, electromagnetic force occurs between the teeth portion 34 and the teeth portion 44, whereby the yarn feed drum 42 rotates with the same rotational frequency of 24 RPM and, in the same direction as that of rotary force transmission disk 25 in following thereto so as to feed the yarn 16 and form the longest pile height.

When the feed of electric current to the toroidal coil 27 of rotary force transmission disk 25 is stopped and electric current is applied to the toroidal coil 27' of rotary force transmission disk 25', the magnetic closed loop at the side of the rotary force transmission disk 25 disappears and a magnetic closed loop, the center of which is the toroidal coil 27', is newly formed whereby the teeth portion 44' of yarn feed drum 42 is covered by the magnetic closed loop newly formed. Magnetic force actuates the teeth portion 44' and the teeth portion 34' which rotate yarn feed drum 42 with the same rotational frequency of 4.8 RPM as that of the rotary force transmission disk 25' and the lowest pile height can be formed.

Therefore, if the feeding ratio of electric current to the rotary force transmission disk 25 and to the rotary force transmission disk 25' during one stitch is changed, the mean rotation speed of the yarn feed drum 42 changes in accordance with this ratio and the desired quantity of yarn can be fed.

It is for this reason that the reason the teeth portions 34, 34', 44, 44' are respectively mounted on the circumference peripheries of the rotary force transmission disk 25, 25' and yarn feed drum 42 so that the magnetic force for rotation can be used more efficiently. This reason is explained in detail in the discussion set forth hereinbelow.

As shown in FIG. 4, if it is assumed that the bulging out convex part of the teeth portion 34 on the rotary force transmission disk 25 is divided into differential parts $dl_1$, $dl_2$, $dl_3$, $dl_4$, $dl_5$, $dl_6$ and a differential part dL takes its position at one point on the bulging out convex part of the teeth portion 44 on the side of the yarn feed drum 42, with the respective convex portions of the teeth portion 34 and the teeth portion 44 facing each other with all respective surfaces, as shown in FIG. 4(*a*), the distances between $dl_1$ and dL and between $dl_5$ and dL, the distance between $dl_2$ and dL and between $dl_4$ and dL are respectively equal, the imaginary line between $dl_3$ and dL being the center line thereof. Thus, the respective magnetic forces therebetween are respectively equal, the magnetic forces actuated between the rotary force transmission disk 25 and the yarn feed drum 42 being in a balanced state, only magnetic attraction actuating vertically to the surface of the rotary force transmission disk 25 and the side surface of the yarn feed drum 42, and the laterally divided force for changing the mutually balanced relation of the position between the rotary force transmission disk 25 and the yarn feed drum 42 does not arise.

Figure 4A:
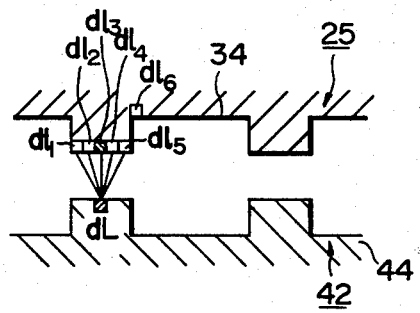
FIG. 4(A), FIG. 4(B) and FIG. 4(C) are explanatory enlarged views of the principle by which the second embodiment operates.
Figure 4B:
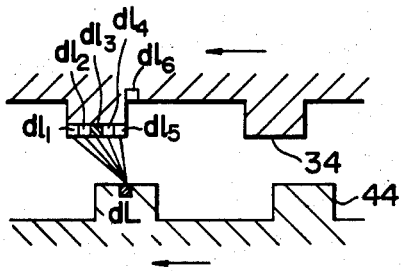

On the other hand, in the case of FIG. 4(B) the teeth portion 34 does not face the teeth portion 44 with all respective faces and becomes eccentric against the teeth portion 44. Therefore, among the magnetic attraction forces therebetween, the strongest one is the magnetic attraction force between $dl_5$ and dL, the next one being the magnetic attraction force between $dl_4$ and dL with the magnetic attraction force decreases according to the order of $dl_4$, $dl_3$, $dl_2$ $d_1$ and $dl_6$. As described above, the magnetic attraction forces among dL and $dl_1 \sim d_6$ are not in such balanced state as shown in FIG. 4(A), only one side of which being stronger, and if the teeth portion 34 rotates, unbalanced magnetic attraction forces arise against the teeth portion 44 from which a lateral force is generated according to the position relation shown in FIG. 4(B), whereby the teeth portion 44 begins to rotate. Thus, the rotating foce of rotary force transmission disk 25 can be transmitted to the yarn feed drum 42, which in turn, begins to rotate.

Figure 4C:
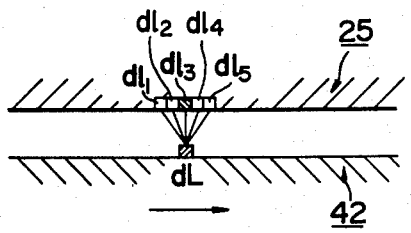

The above-noted lateral force can be generated by the teeth portion 34 and the teeth portion 44 formed respectively on the rotary force transmission disk 25 and on the outer side of the yarn feed drum 42. As shown in FIG. 4(C), if there is no teeth portion and the surfaces of the rotary force transmission disk 25 and the outer side of the yarn feed drum 42 are respectively flat. However, the position relation therebetween may change, the magnetic attraction forces among dL and $dl_1 \sim dl_5$, the center of which being the magnetic attraction force between dL and $dl_3$, being symmetrical on the right hand and on the left hand side and are in a balanced state, similar to the state shown in FIG. 4(A). Therefore, no lateral force can be generated. Accordingly, the yarn feed drum 42 does not follow the rotary force transmission disk 25 and can not rotate.

The above description discloses the reason why the teeth portion 34 and the teeth portion 44 are formed and the principle for making yarn feed drum 42 rotary by rotary force transmission disk 25' is quite the same in that yarn feed drum 42 is made to rotate by rotary force transmission disk 25. For making the transmission force large enough to transmit the lateral force, in other words, a large rotating force, the effective methods are to make the height of the convex part of the teeth portion higher, to make the respective diameters of the rotary force transmission disks 25, 25' and the yarn feed drum 42 larger, to make the electro magnetic force generated in the toroidal coils 27, 27', stronger and to make the distances between the teeth portion 34 and the teeth portion 44 and between the teeth portion 34' and the teeth portion 44' smaller. The teeth 34, 44 and the teeth portion 34', 44' must be set respectively in a facing position with respect to each other but need not be set on the round periphery portions of the rotary force transmission disks 25, 25' and the outer side of the yarn feed drum 42. The teeth portions 34, 44, 34', 44' may be set at any portion thereof, but when they are set on the round periphery portions, it is a matter of course that the torque becomes larger and a larger rotary force can be obtained.

If the rotation of the rotary force transmission disk at the side to which electric current is fed is forced to stop, the rotation of yarn feed drum 42 is stopped by electromagnetic force and the feeding of yarn can be stopped.

As a second example of a second embodiment of the present invention as described above, the feed quantity of yarn can be easily controlled electrically by the regulation of the feed ratio of electrical current to the doughnut like coil 27 and the doughnut like coil 27' during one stitch. For example, in the case where a tufting machine is used, the height of yarn can be exactly controlled whereby a beautiful modification due to the difference of height can be offered. Moreover, in the composition thereof, there are no mutual contacts between the main composing elements and therefore, the device according to the present invention has very excellent endurance, the driving sources thereof depending on an independent power source with the composition of the elements of the present invention being very simple, and, being small in size, does not occupy a large space and can be easily set in a desired or necessary place. These are some of the resulting excellent effects of the apparatus according to the present invention. Moreover, even the highest pile length and the lowest pile length can be changed respectively by changing the speeds of the rotary transmission disks 25, 25'.

Figure 7:
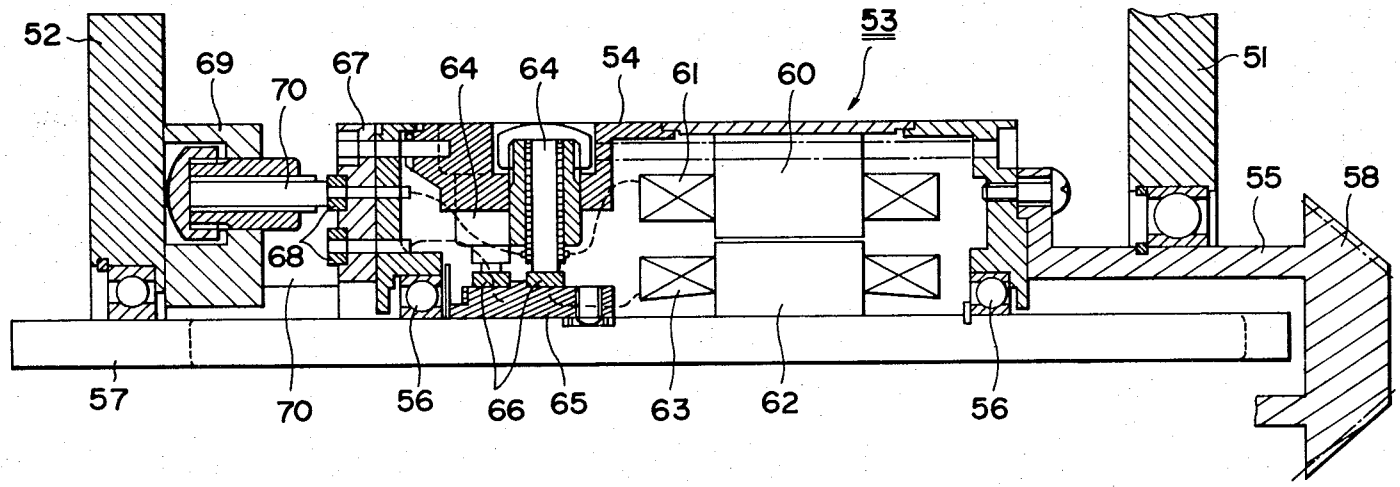
FIG. 7 is an enlarged sectional view of a portion of the third embodiment shown in FIG. 6.
Figure 8:
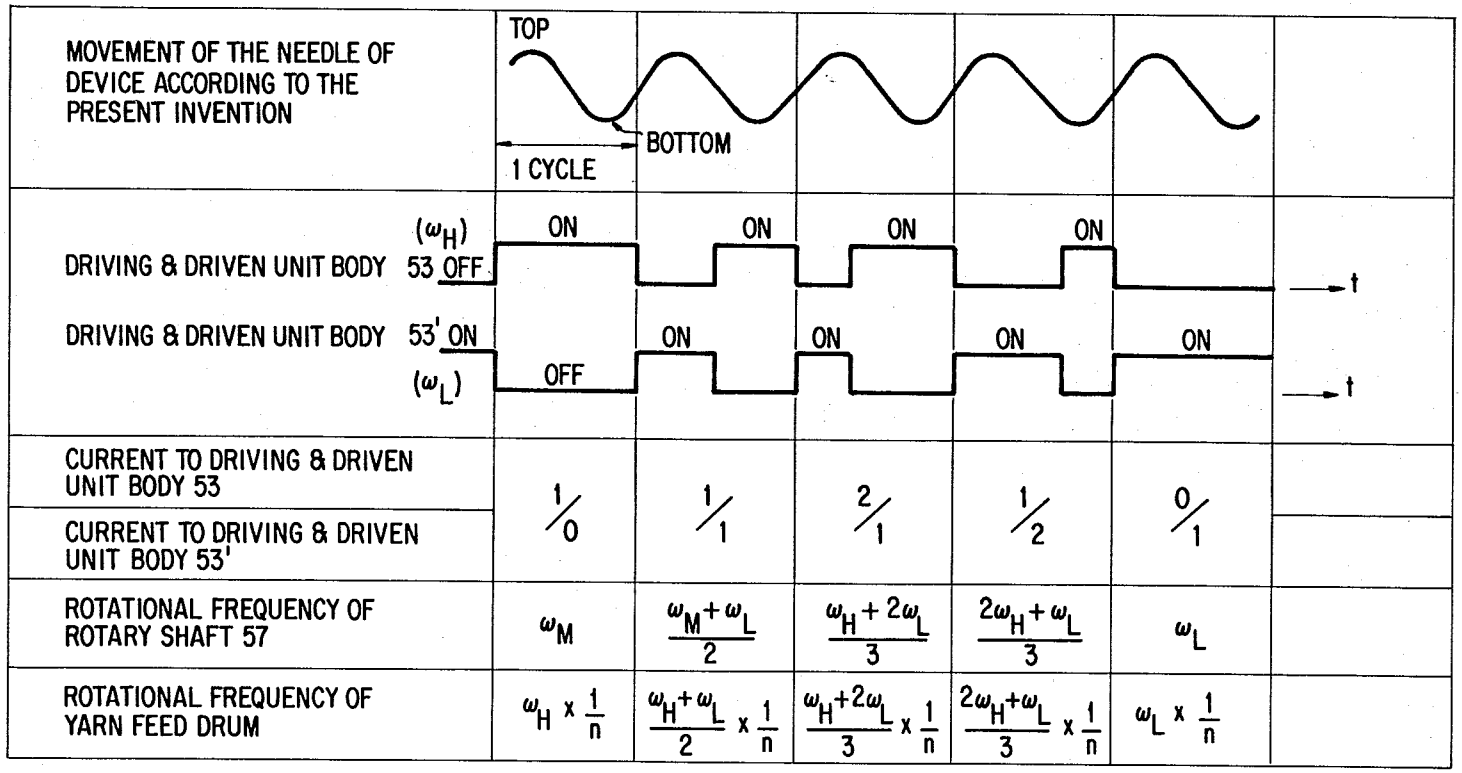
FIG. 8 is a table explaining the rotations of one driving and driven unit body, the other driving and driven unit body and the yarn feed drum of the present invention; and, FIG. 9 shows a partial sectional view of the gears and reversible rotor of the embodiment of FIG. 1.

A third embodiment of the present invention is explained in detail according to FIGS. 5 to 8. At one end of a supporting base 50 is mounted a journal bearing 51, at the other end of a supporting base 50 is mounted a journal bearing support 52 with a space between the journal bearing support 52 and the journal bearing support 51 through which penetrate respectively rotary cylinders 55, 55' which are respectively fixed on one side wall of the casings 54, 54' of the driving and driven unit bodies 53, 53', mounted on the journal bearing support 51. Rotary shaft 57 and the rotary shaft 57' are respectively inserted into rotary cylinders 55, 55' and are respectively supported on one side wall and at the other side wall of the casings 54, 54' by the respective journal bearing 56 56, 56', 56' and penetrate both side walls of the casings 54, 54', and are respectively supported at an opposite end journal bearing by support 52 through which one rotary shaft 57 and the other rotary shaft 57' pass as shown in FIG. 7.

At the outer ends of the rotary cylinders 55, 56' are fixed bevel gears 58, 58' which have the same diameter and engage respectively bevel gears 59, 59' which also have the same diameter and are respectively driven by an outer driving source, not shown, whereby the casing 54, 54' of the driving and driven unit bodies 53, 53' are rotated.

Driving and driven unit bodies 53, 53' are composed as described hereinbelow. As the composition of the driving and driven unit body 53 is the same as that of the driving and driven unit body 53', only the composition of the driving and driven unit body 53 is explained in accordance with FIG. 7. In other words, on the inner wall of casing 54 are mounted an even numbered plurality of stators 60 radially around which equally spaced coils 61 are wound and on rotary shaft 57 are fixed rotors 62, which include the same number of rotors as that of the stators 60, and show the same polarity alternately, and around which the coils 63 are wound. Electric current is fed to the coils 61, 63 respectively from slip rings 66, 66 wound around a cylindrical and electrically insulating body 65 fixed on the rotary shaft 57 and brushes 64, 64 mounted on the inner wall of the casing 54 with a space provided therebetween, both brushes 64, 64 respectively being electrically in contact with slip rings 68, 68 concentrically mounted on an electrically insulating body 67 fixed at the one side of the casing 54. On the side of journal bearing 52 is fixed an electrically insulating body 69 on which are mounted brushes 70, 70 with a space provided therebetween and which are respectively in contact with slip rings 68, 68.

Figure 5:
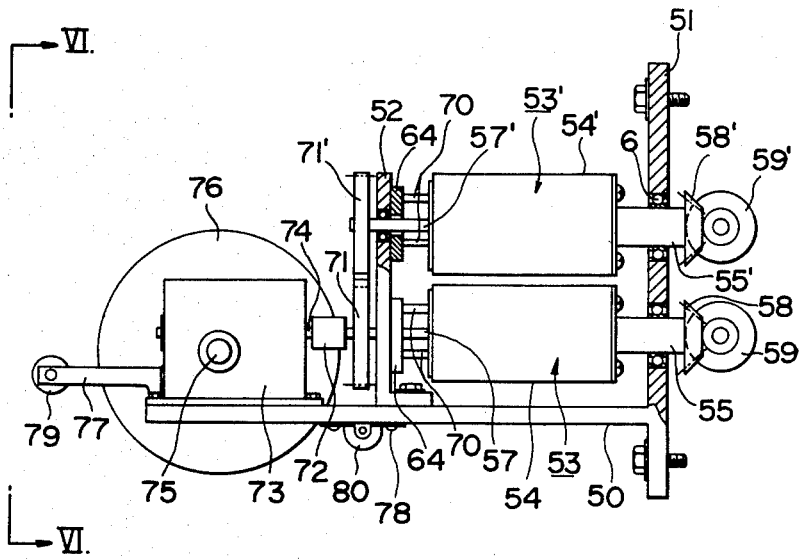
FIG. 5 is a front, partially sectional view of a third preferred embodiment according to the present invention.
Figure 6:
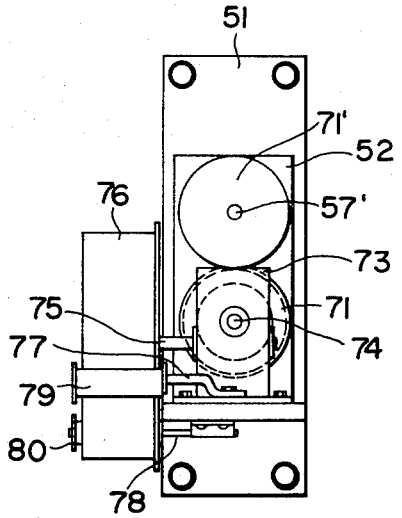
FIG. 6 is a side view of FIG. 5 taken along line VI—VI.

Both rotary shafts 57, 57' are respectively mounted with one gear 71 and another gear 71', which have the same diameter and engage each other, at the respective end thereof as shown in FIG. 5 with one rotary shaft 57 being in communication with an input shaft 74 of gear box 73 set on supporting base 50 by means of a coupling 72. In the gear box 73 are provided a worm gear and a worm wheel, not shown, which reduce the rotation speed to 1/n by the gear ratio thereof and drive an output shaft 75 on which the yarn feed drum 76 is fixed. On the upper surface and the lower surface of the supporting base 50 are respectively fixed arms 77, 78 on which guide rollers 79, 80 are respectively mounted.

Assuming that bevel gear 59 is rotated with a rotational velocity $\omega H$ by which the highest pile height can be achieved and bevel gear 59' is rotated with a rotational velocity $\omega L$ by which the lowest pile height can be achieved, if electric current is fed to one driving and driven unit body 53 rotating with the highest velocity $\omega H$, stator 60 and rotor 62 are respectively excited and show respectively the same polarity alternately, as designed by the resulting magnetic force, such that the stator 60 and the rotor 62, that have a different nature pole respectively, attract each other whereby magnetic synthesis can be achieved, the relative relation of position between the stator 60 and the rotor 62 being fixed. The rotary shaft 57 can thus be rotated at the highest velocity H which is reduced to 1/n by means of gear box 73 so as to rotate feed drum 76 with a rotational velocity of $H \times 1/n$ and the quantity of yarn which is necessary to obtain the longest pile height can therefore be fed.

On the contrary, if the feed of electric current to one driving and driven unit body 53 is stopped and electric current is applied to the other driving and driven unit body 53', which is rotating with the lowest velocity $\omega L$, the rotary shaft 57' rotates with the lowest velocity $\omega L$ such that the input shaft can be rotated with the lowest velocity $\omega L$ through one gear 71 and the other gear 71', whereby the yarn feed drum 76 can be rotated with the velocity $\omega L \times 1/n$ and the quantity of yarn necessary for the lowest pile height can thus be fed. In this mode of feeding, the rotary shaft 57 is idling with a velocity $\omega L$ because it is directly connected to the gear 71.

Therefore, the mean rotational speed of the yarn feed drum 76 can be changed by changing the ratio of the electric current feed time to the one driving and driven unit body 53 and to the other driving and driven unit body 53' during one stitch. The relations described above are shown in FIG. 8 as a table.

The casing 54, 54' of the one driving and driven unit body 53 and the other driving and driven unit body 53' can be rotated respectively with the two different kinds of velocity $\omega H$ and $\omega L$, the different mean speeds can be obtained by controlling the time ratio of the electric current feed to the one driving and driven unit body 53 and the other driving and driven unit body 53' with respect to the rotational frequency between the highest speed and the lowest speed, whereby in the case of $\omega H$, the loop pile height which is tufted is maximum and in the case of $\omega L$ the loop pile is minimum. Thus, any necessary loop pile length between the maximum and the minimum can be obtained linearly by controlling the ratio of the feed of electric current.

$\omega H$ and $\omega L$ can be controlled respectively. Therefore, even the maximum loop pile length or the minimum loop pile length can be controlled freely by means of a variable speed motor or a variable reducing machine applied to a driving source of the device according to the present invention.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for controlling the feed of yarn from a yarn feed drum which comprises:

first and second shaft members;

first and second gears respectively driven by said first and said second shaft members;

a third shaft member which has said first gear mounted at one end thereof and said second gear mounted at the other end thereof;

means for driving said third shaft member in a clockwise and counterclockwise direction; and first and second one way clutch members respectively mounted between said first gear and said third shaft member and between said second gear and said third shaft member, said first and said second one way clutches being locked in a counter direction with respect to one another and said third shaft member being connected to said yarn feed drum.

* * * * *